US005156474A

United States Patent [19]

Kurosawa et al.

[11] Patent Number: 5,156,474

[45] Date of Patent: Oct. 20, 1992

[54] METHOD OF CONTROLLING AN INK RIBBON MOVING SPEED IN A DOT LINE PRINTER

[75] Inventors: Hiroyuki Kurosawa; Yoshikane Matsumoto; Shozo Ishii; Kiichi Morota, all of Katsuta, Japan

[73] Assignee: Hitachi Koki Co., Ltd., Tokyo, Japan

[21] Appl. No.: 658,894

[22] Filed: Feb. 22, 1991

[30] Foreign Application Priority Data

Feb. 23, 1990 [JP] Japan ..... 2-042816
Nov. 9, 1990 [JP] Japan ..... 2-305766

[51] Int. Cl.[5] ..... B41J 33/36

[52] U.S. Cl. ..... 400/232; 400/225; 400/323

[58] Field of Search ..... 400/232, 225, 323, 233, 400/230; 101/93.04

[56] References Cited

U.S. PATENT DOCUMENTS

| | | | |
|---|---|---|---|
| 4,286,888 | 9/1981 | Bennett | 400/320 |
| 4,300,847 | 11/1981 | Hoffman | 400/196.1 |
| 4,558,963 | 12/1985 | Applegate | 400/120 |
| 4,728,206 | 3/1988 | Mori | 400/225 |
| 4,850,725 | 7/1989 | Walker | 400/236.2 |

FOREIGN PATENT DOCUMENTS

| | | | |
|---|---|---|---|
| 194593 | 11/1983 | Japan | 400/232 |
| 19189 | 1/1984 | Japan | 400/232 |
| 187885 | 10/1984 | Japan | 400/232 |
| 20794 | 1/1986 | Japan | 400/232 |
| 61-72575 | 4/1986 | Japan . | |
| 61-72576 | 4/1986 | Japan . | |
| 272186 | 12/1986 | Japan | 400/232 |
| 233271 | 10/1987 | Japan | 400/232 |
| 267180 | 11/1987 | Japan | 400/232 |
| 296976 | 12/1988 | Japan | 400/232 |
| 52785 | 2/1990 | Japan | 400/232 |

OTHER PUBLICATIONS

IBM Technical Disclosure Bulletin, vol. 29, #11, "Mechanical Ribbon Saver . . . ", Apr. 1987.

IBM Technical Disclosure Bulletin, vol. 30, #8, "Ribbon Feed Mechanism . . . ", Jan. 1988.

*Primary Examiner*—David A. Wiecking
*Assistant Examiner*—E. P. Raciti
*Attorney, Agent, or Firm*—Sughrue, Mion, Zinn, Macpeak & Seas

[57] ABSTRACT

In a shuttle dot line printer including a hammer bank shuttling back and forth at a given speed in a direction to transverse a sheet of print paper while turning around at two opposite ends, and an endless ink ribbon unidirectionally moving through a space between the hammer bank and the sheet of print paper, the ink density of the characters printed when the hammer bank is moving in the direction opposite to the ink ribbon is lowered. To prevent such occurrence, the ink ribbon is moved at a low speed lower than a regular speed when the moving direction of the hammer bank is opposite to that of the ink ribbon. On the other hand, when the moving direction of the hammer bank is same as that of the ink ribbon, the ink ribbon is moved at the regular speed after a predetermined period of time has been expired when the hammer bank turns around at one end and starts moving in the same direction as the ink ribbon.

10 Claims, 4 Drawing Sheets

RIGHTMOST POSITION
CENTER
LEFTMOST POSITION
t15
t16
t17
t18

MOVING DIRECTION OF H.B.
RIGHTWARD MOVEMENT
SPEED
0
LEFTWARD MOVEMENT
25
26
25
26
20
19
t
T1
T2
T

SENSOR PULSES
31
33
32
36
31
34
35
H
I t15
t16
t17
t18
RIGHTMOST POSITION
CENTER
LEFTMOST POSITION

MOVING DIRECTION OF H.B.
25
26
25
26
RIGHTWARD MOVEMENT
20

SPEED
0
19
t
T1
T
LEFTWARD MOVEMENT
33
36
31
34
32
31

SENSOR PULSES
37
35
H
I

METHOD OF CONTROLLING AN INK RIBBON MOVING SPEED IN A DOT LINE PRINTER

BACKGROUND OF THE INVENTION

The present invention relates to a method of controlling the moving speed of an ink ribbon in a shuttle dot line printer.

A shuttle dot line printer has a hammer bank accommodating a plurality of print hammers juxtaposed along a print line. To carry out printing, the hammer bank shuttles back and forth in a direction transverse to a sheet of print paper. During the movement of the hammer bank, the print hammers are selectively fired so as to make dot impressions on the sheet of print paper through an ink ribbon.

FIG. 1 is a plan view showing a conventional shuttle dot line printer which includes a hammer bank 1, a shuttle mechanism 2 for shuttling the hammer bank 1 back and forth in directions C and D perpendicular to an advancing direction of a sheet of print paper 3, and an endless ink ribbon 4. The ink ribbon 4 is stored in an ink ribbon cassette (not shown) in folded state and is withdrawn therefrom to pass through a space between the print paper 3 and the hammer bank 1. The ink ribbon 4 is supported by a pair of ribbon drive rollers 5, a guide roller 6, ribbon guides 7, 8, and a braking portion 9, and is uni-directionally transported in the direction B by the drive rollers 5 rotating in the direction A. To prevent the ink ribbon 4 from being slackened, a braking force is imparted on the outgoing ink ribbon 4 by the braking portion 9.

When the hammer bank 1 moves in the direction D, the moving direction thereof is in coincidence with that of the ink ribbon 4, whereas when the hammer bank 1 moves in the direction C, the moving direction thereof is opposite to that of the ink ribbon 4. When the moving directions of the hammer bank 1 and the ink ribbon 4 are opposite to each other, a force is imparted on the ink ribbon 4 by the impingement of the hammers thereon, tending to pull the ink ribbon 4 toward the moving direction of the hammer bank 1. As a consequence, the portion of the ink ribbon 4 confronting the hammer bank 1 moves at a very slow speed or it may even be instantaneously stopped. Since the ink ribbon 4 is being constantly pulled by the drive roller 5, the ink ribbon 4, at locations between the hammer bank 1 and the drive roller 5, is stretched. The slack created by this stretch is eliminated when the hammer bank 1 changes its moving direction from direction C to D.

More specifically, the slack is eliminated when the printing performed during the opposite directional movement of the hammer bank 1 is terminated and hence the ink ribbon 4 is brought to a condition substantially free from the load imparted by the print hammers. In the course of removing the slack of the ink ribbon 4, the moving speed of the ink ribbon 4 instantaneously increases and is then momentarily equal to the moving speed of the hammer bank 1 moving in the same direction D as the ink ribbon 4. When the relative moving speed of the ink ribbon 4 to the hammer bank 1 is zeroed, the same portion of the ink ribbon 4 is subjected to repetitive impingements by the print hammers, thereby lowering the ink density of the printed characters.

In order to prevent this degradation of the printing quality, it has been proposed to reverse the moving direction of the ink ribbon to agree with the moving direction of the hammer bank 1. However, an ink ribbon reversing mechanism necessary to accomplish this effect is complicated and costly. Further, for high speed dot line printers having a printing capability of 300 to 400 Kanji characters per minute, it is technically difficult to reverse the moving direction of the ink ribbon 4 in synchronism with the reversal of the hammer bank 1 which takes place every 40 to 50 milliseconds.

Another proposal for preventing degradation of print quality is to slow down the moving speed of the ink ribbon 4 when the hammer bank 1 moves in the opposite direction to the ink ribbon 4. The rotational speed the ribbon drive rollers 5 is reduced in synchronism with the change of the moving direction of the hammer bank 1 and this slow down movement of the ink ribbon 4 is continued during the opposite directional movement of the ink ribbon 4. However, such a proposal does not solve the problem. In the high speed dot line printers, the hammer bank 1 starts printing within about 5 milliseconds after it turns around at the ends of the reciprocal path. The stretch of the ink ribbon 4 has not yet been completely restored within such a short period of time. Therefore, the accelerated movement of the ink ribbon 4 still occurs even if the speed of the ink ribbon is changed in synchronism with the change in the moving direction of the hammer bank 1. Rather, the moving speed thereof tends to be further accelerated and the lowering of the print density is not eliminated.

In the foregoing description, it is to be noted that the ink ribbon speed is lowered for the purpose of attaining suppression of the stretch of the ink ribbon 4. The ink ribbon speed needs to be returned to the regular speed for the following reasons. If the ink ribbon 4 is constantly moving at the lower speed, the printed characters tend to become blurred resulting from increased number of print hammer impingements on a unit length ink ribbon 4 in comparison with the case where the ink ribbon 4 is moved at the regular speed. Further, if the ink ribbon 4 is constantly moving at the lower speed, the ink ribbon base cloth would be damaged due to the increased number of impingements of the print hammers thereon. The ink ribbon base cloth may be perforated or frayed, with the result that smooth transportation of the ink ribbon 4 cannot be assured.

SUMMARY OF THE INVENTION

In view of the foregoing, it is an object of the present invention to prevent an ink density of printed characters from being lowered due to a change in the moving direction of a hammer bank relative to the moving direction of an ink ribbon.

In order to achieve the above and other objects, there is provided, according to one aspect of the present invention, a method of controlling an ink ribbon moving speed applied to a dot line printer which includes a hammer bank shuttling back and forth at a given speed in a direction transverse to a sheet of print paper. The hammer bank accommodates a plurality of print hammers. An endless ink ribbon uni-directionally moves through a space between the hammer bank and the sheet of print paper and the print hammers are selectively fired to make dot impressions on the sheet of print paper through the ink ribbon. The method of the present invention consists of the steps of detecting a direction in which the hammer bank moves, moving the ink ribbon at a first speed slower than a second speed when the moving direction of the hammer bank is opposite to that of the ink ribbon, and moving the ink ribbon at the second speed after a predetermined period of time has expired from a time when the hammer bank turns around at one of the two opposite ends of the paper and starts moving in the same direction as the ink ribbon.

According to another aspect of the present invention, there is provided a dot line printer which includes a hammer bank shuttling back and forth at a given speed in first and second directions opposite to each other. The hammer bank accommodates a plurality of print hammers. An endless ink ribbon uni-directionally moves in the first direction through a space between the hammer bank and a sheet of print paper, and the print hammers are selectively fired to make dot impressions on the sheet of print paper. A direction detecting device for detecting a direction in which the hammer bank moves, produces a first signal when the hammer bank turns around at one end and thereafter moves in the direction opposite to the ink ribbon, and a second signal when the hammer bank turns around at another end and thereafter moves in the same direction as the ink ribbon. An ink ribbon moving device is selectively responsive to the first and second signals for selectively moving the ink ribbon at first and second moving speeds, the first moving speed is slower than the second moving speed. The ink ribbon moving device moves the ink ribbon at the first moving speed in response to the first signal and at the second moving speed after a predetermined period of time has been expired from the production of the second signal.

It is preferable that the first and second speeds of the ink ribbon are substantially equal to one-fifth and one-half of the speed of the hammer bank, respectively.

Further, the predetermined period of time is equal to or less than a half of a period of time necessary for the hammer bank to move from one end to the other. Preferably, the ink ribbon is brought to the first speed at the time when the hammer bank changes its moving direction to move in the direction opposite to the moving direction of the ink ribbon with respect to a dot line printer having a printing capability of about 300 to 400 lines per minute. In super high speed dot line printer having a printing capability of about 600 lines per minute, the ink ribbon is brought to the first speed before the hammer bank changes it moving direction to move in the direction opposite to the moving direction of the ink ribbon.

The above and other objects, features and advantages of the present invention will become more apparent from the following description when taken in conjunction with the accompanying drawings in which preferred embodiments of the present invention is shown by way of illustrative examples.

DETAILED DESCRIPTION OF THE PREFERRED EMBODIMENTS

Figure 1:
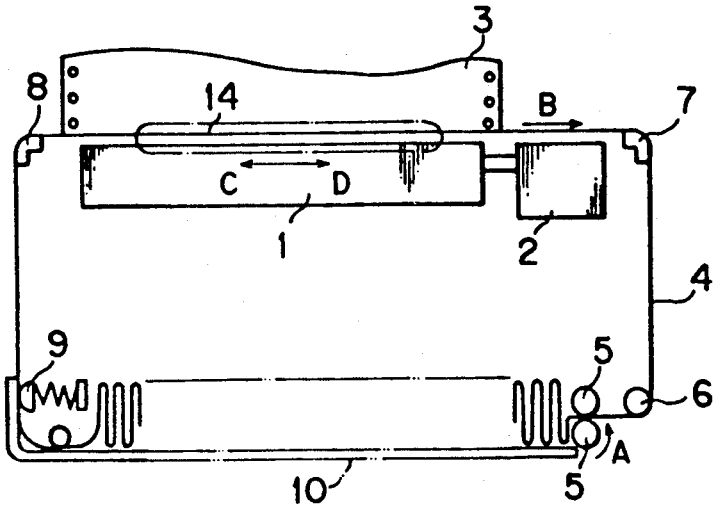
FIG. 1 PRIOR ART
FIG. 1 is a plan view showing an essential portion of a conventional dot line printer.
Figure 2:
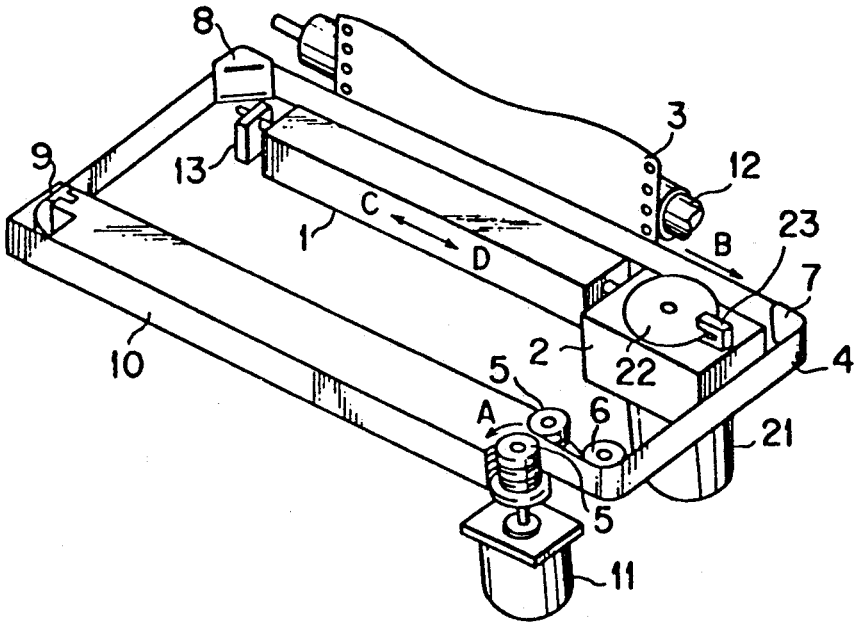
FIG. 2 is a perspective view showing an essential portion of a dot line printer to which the present invention is applied.

In FIG. 2, similar parts or components to those shown in FIG. 1 are denoted by the same reference numerals. A dot line printer shown therein includes a platen 12 rotatable about its own axis, a hammer bank support member 13 for slidably supporting a hammer bank 1 thereon, and a shuttle motor 21 which constitutes a shuttle mechanism 2 together with a cam mechanism (not shown). The shuttle motor 21 has a rotational shaft, and a disk-shaped encoder 22 formed with angularly spaced slits is fixed to the upper portion thereof for detecting a position of the hammer bank 1. An optical sensor 23 is disposed in one side of the encoder 22 for sensing light emitted from a light emitting diode (not shown) disposed in the other side thereof.

The printer further includes a ribbon drive motor 11 directly coupled to a drive roller 5. As will be described in detail below, the rotational speed of the motor 11 is varied substantially in synchronism with the movement of a hammer bank 1.

Figures 3A, 3B, 3C:
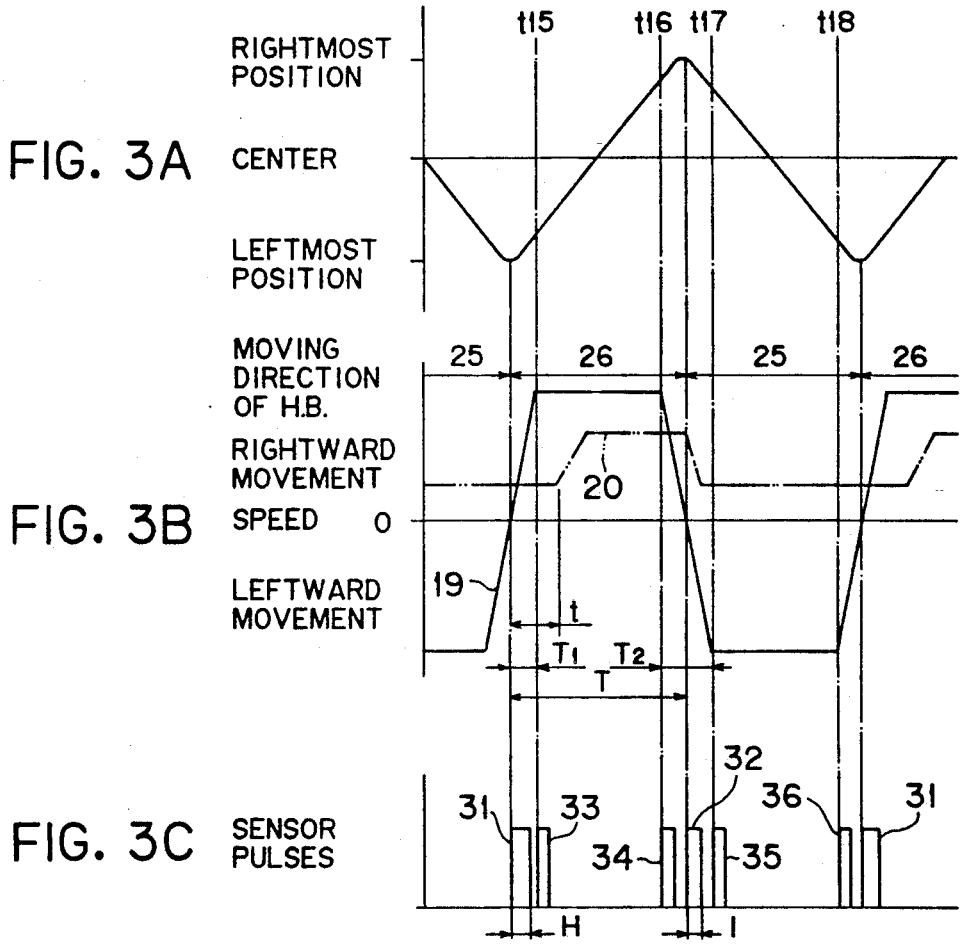
FIG. 3A is a graphical representation showing a displacement of a hammer bank according to a first embodiment of the present invention.
FIG. 3B is a graphical representation showing the moving speed of the hammer bank and a rotational speed of a ribbon drive motor according to the first embodiment of the present invention.
FIG. 3C is a graphical representation showing output pulses produced from an optical sensor according to the first embodiment of the present invention.

FIG. 3A indicates a displacement of the hammer bank 1 when it shuttles back and forth. At times $t_{15}$ and $t_{16}$, the hammer bank 1 is in print start and print end positions, respectively, in a cycle when the hammer bank 1 is moving rightwardly. At times $t_{17}$ and $t_{18}$, the hammer bank 1 is in print start and print end positions, respectively, in a cycle when the hammer bank 1 subsequently moves leftwardly. Referring to FIG. 3B, in the durations indicated by numeral 25, the hammer bank 1 moves in the opposite direction C to the ink ribbon 4, whereas in the durations indicated by numeral 26, the hammer bank 1 moves in the same direction D as the ink ribbon 4. The moving speed of the hammer bank 1 is indicated by a solid line 19, and the rotational speed of the ribbon drive motor 11 by a two-dotted chain line 20. It is to be noted that the rotational speed of the ribbon drive motor 11 is equivalent to the moving speed of the ink ribbon 4.

As shown by the line 20 in FIG. 3B, the drive motor 11 rotates at a constant low speed substantially over a period of time when the hammer bank 1 moves in the direction C (see FIG. 2) opposite to the direction in which the ink ribbon 4 moves. On the other hand, the drive motor 11 rotates at a constant regular speed higher than the low speed substantially over a period of time when the hammer bank 1 moves in the same direction D as the ink ribbon 4. The rotational speed of the drive motor 11 changes from low to regular after expiration of time t from the reversal of the hammer bank 1 occurring most recently.

The time t is determined to fall within a range of $T_1 \leqq t \leqq 0.5$ T where $T_1$ is a period of time from the reversal of the hammer bank 1 at the leftmost position to the arrival of the hammer bank 1 at the print start position $t_{15}$, and T is a period of time during which the hammer bank moves from one end to the other in its moving path.

The minimum value of time t is determined based on the following reasons. In the durations 25, the stretch of the ink ribbon 4 is not zero but is still outstanding even if the ink ribbon 4 moves at the low speed. The restoration of the stretch starts when the hammer bank 1 has reached the print end position at time $t_{18}$ in the course of the reversal movement of the hammer bank 1. The accelerated movement of the ink ribbon 4 continues until the hammer bank 1 turns around at the leftmost position and then arrives at the print start position at time $t_{15}$. Therefore, the rotational speed of the drive motor 11 should not be changed from low to normal until the accelerated movement of the ink ribbon 4 is completely ended. By doing so, the relative moving speed of the ink ribbon with respect to the hammer bank 1 is not zeroed. For the reason stated above, the time when the rotational speed of the drive motor 11 is changed from low to regular must be delayed at least by time $T_1$ from the reversal of the hammer bank 1 where $T_1$ is defined by a period of time from the reversal of the hammer bank 1 at the leftmost position to the arrival of the hammer bank 1 at the print start position $t_{15}$ as shown in FIG. 3B.

The maximum value of time t is determined based on the following reasons. The present inventors have found that the printed ink density can be prevented from lowering if time t is set to a range from 10 to 20 milliseconds corresponding to 20 to 40% of time T. The change in the ink ribbon moving speed after the hammer bank 1 turns around was investigated and found that after about 0.5 T the ink ribbon moving speed was no longer changed. Hence, the maximum of time t is determined to be 0.5 T from the reversal of the hammer bank 1 occurring most recently.

As illustrated in FIG. 3B, the change in the rotational speed of the drive motor 11 from regular to low is preferably taken place at a time when the hammer bank 1 changes its moving direction to be opposite to the moving direction of the ink ribbon 4. However, the change from regular to low may take place at any time within a period of time $T_2$ defined by time $t_{16}$ and $t_{17}$.

FIG. 3C illustrates signal waveforms outputted from the optical sensor 23 used in conjunction with the encoder 22. The waveform denoted by numeral 31 is issued from the optical sensor 23 when the hammer bank 1 has reached the leftmost position whereas the waveform denoted by numeral 32 is issued therefrom when the hammer bank 1 has reached the rightmost position. The waveforms 31 and 32 have different durations H and I (H>I), so that a difference between the two durations makes it possible to identify the position of the hammer bank 1. The print start and print end positions can be identified by the signals 33 through 36 issued upon sensing of the slits of the encoder 22. Specifically, the print start signals 33, 35 are issued immediately after the issuances of the signals 31, 32, respectively, and the print end signals 34, 36 are identified by the number of sensor pulses outputted from the optical sensor 23.

Figure 5:
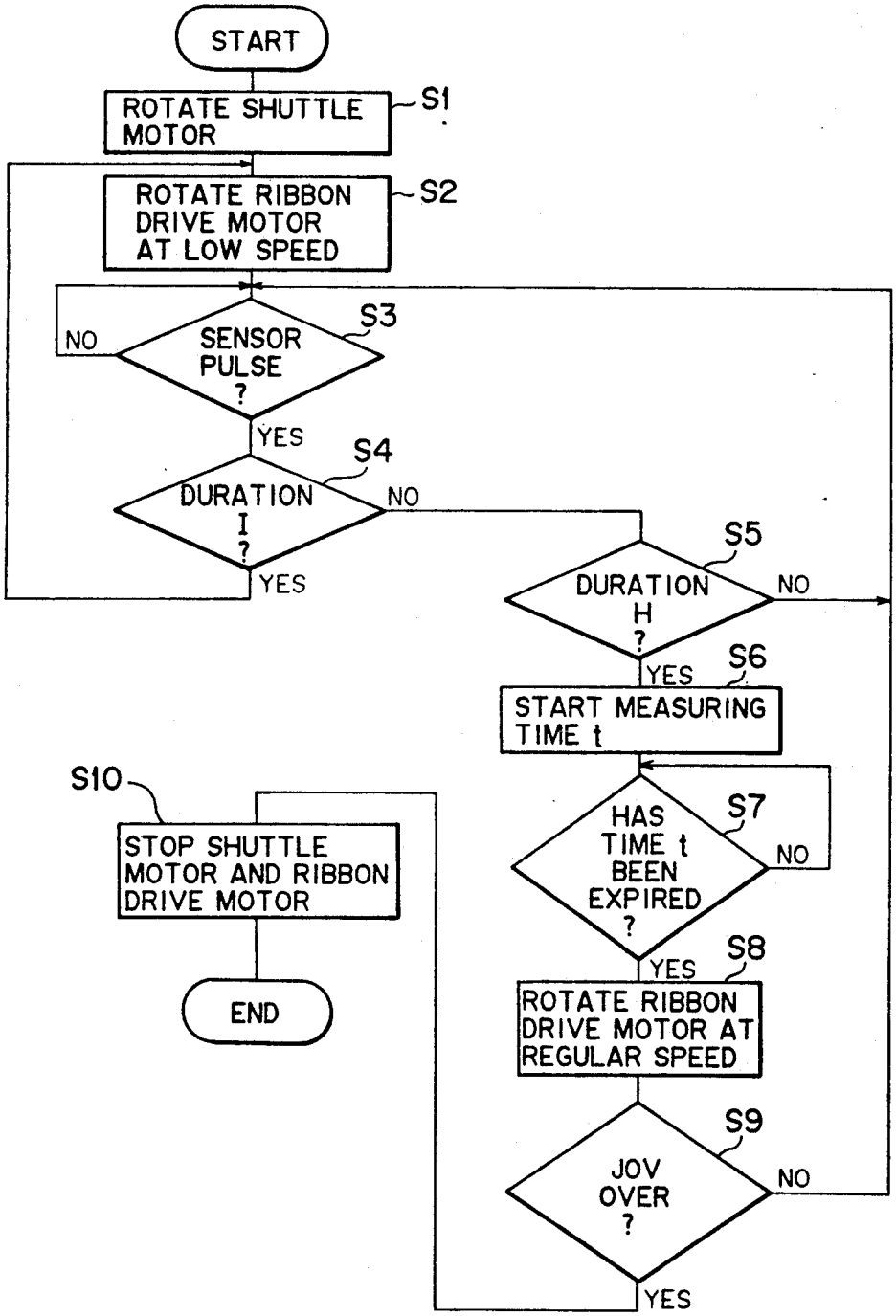
FIG. 5 is a flow chart for description of the operational sequence of the first embodiment of the present invention.

Next, referring to the flow chart of FIG. 5, a method of controlling the moving speed of the ink ribbon 4 will be described.

When a print start button (not shown) is depressed, both the shuttle motor 21 and the ribbon drive motor 11 are energized (steps S1 and S2). At this time, the ribbon drive motor 11 rotates at the low speed. Next, it is determined whether the leading edge of the pulse outputted from the optical sensor 23 is detected or not (step S3). If yes, it is determined whether the pulse has a duration of I (step S4). This determination is carried out by counting the number of clock pulses produced during a period of time from the occurrence of the leading edge until the occurrence of the falling edge of the pulse. If the determination made in step S4 indicates that the pulse has a duration I, it is understood that the hammer bank 1 is in the rightmost position. Accordingly, the routine returns to step S2 where the ink ribbon drive motor 11 is continuously moved at the low speed. If, on the other hand, the pulse does not have a duration of I, then it is determined whether the pulse has a duration of H which is longer than the duration I (step S5). If no, the processings in steps S3 and S4 are repeatedly carried out until the pulse having a duration H is detected. Detection of the pulse having the duration H indicates that the hammer bank 1 has reached the leftmost position. Upon detection of the pulse having the duration H, measurement of time t is started (step S6). If it is determined that time t has been expired (yes in step S7), then the ink ribbon drive motor 11 is changed to rotate at the regular speed (step S8). Next, it is determined whether the printing job has been over (step S9). If no, the routine returns to step S3 and the processings S3 through S8 are repeatedly carried out. If the step S9 indicates that the printing job has been over, both the shuttle motor 21 and the ink ribbon drive motor 11 are de-energized.

The time t defined by the range of $T_1 \leqq t \leqq 0.5$ T can be determined based on signals produced, for example, from a microcomputer which monitors a time elapsing from a time when the hammer bank 1 has reached the leftmost position or based on signals produced upon counting a predetermined number of pulses from the optical sensor 23.

As described, the stretch of the ink ribbon 4 can be suppressed by controlling the rotational speed of the drive motor 11 at specific times, and thus the influence caused by the stretch of the ink ribbon 4 can substantially be obviated.

The foregoing embodiment is directed to dot line printers having a printing capability of about 300 to 400 lines per minute, in which the regular speed of the ink ribbon 4 is 170 mm/sec and the low speed thereof is 70 mm/sec when the hammer bank 1 is moving at a speed of 350 mm/sec. The regular and low speeds of the ink ribbon 4 is about one-second and one-fifth relative to the moving speed of the hammer bank, respectively.

The present inventors noted that the above-described controlling method is still insufficient for a super high speed dot line printers having a printing capability of about 600 lines per minute.

Figures 4A, 4B, 4C:
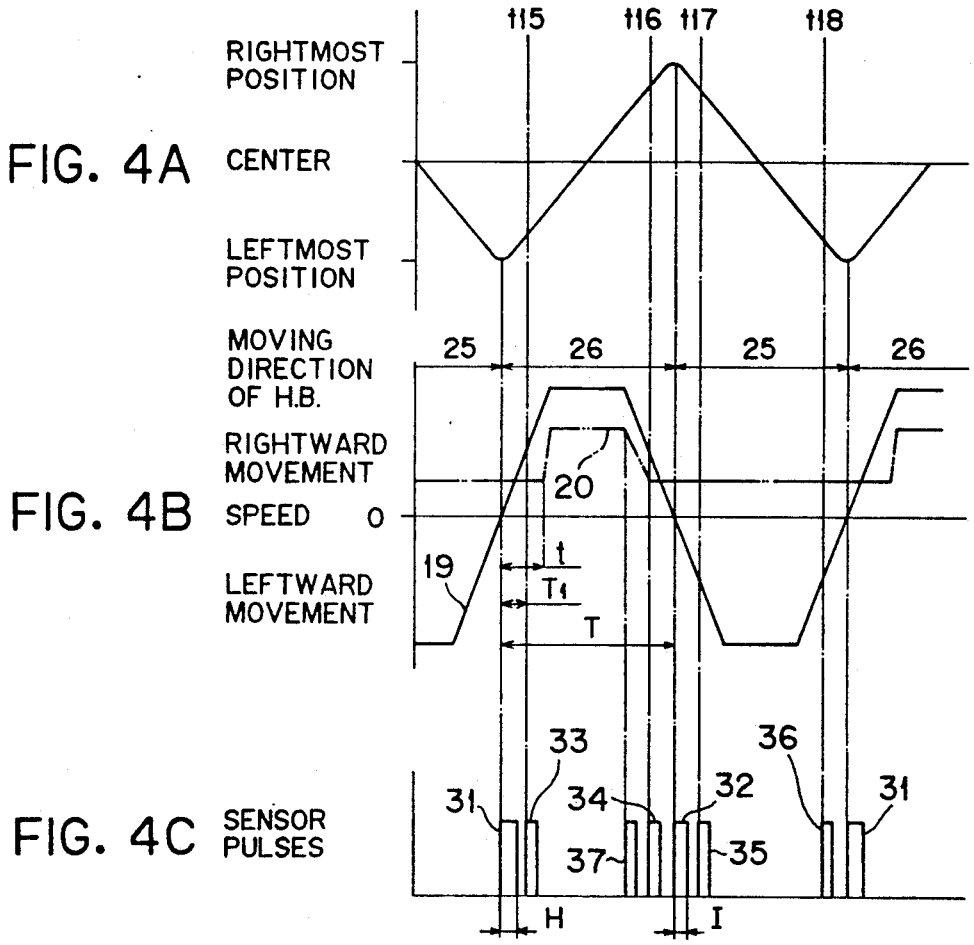
FIG. 4A is a graphical representation showing a displacement of a hammer bank according to a second embodiment of the present invention.
FIG. 4B is a graphical representation showing the moving speed of the hammer bank and the rotational speed of the ribbon drive motor according to the second embodiment of the present invention.
FIG. 4C is a graphical representation showing the output pulses produced from the optical sensor according to the second embodiment of the present invention.

Another embodiment applied to a super high speed dot line printer will be described with reference to FIGS. 4A through 4C which are similar to FIGS. 3A through 3C but different therefrom in that the time when the ink ribbon 4 returns to a regular speed is set earlier and the time when the moving speed of the ink ribbon 4 is changed from regular to low is set earlier. In FIGS. 3A through 3C, the moving speed of the ink ribbon 4 is changed from regular to low in coincidence with the reversal of the hammer bank 1 whereas in FIGS. 4A through 4C, the speed of the ink ribbon 4 is changed to low before the hammer bank 1 turns around and has already been at low when the hammer bank 1 has reached the print end position.

For the super high dot line printers, the regular and low speeds of the ink ribbon 4 are typically 170 mm/sec and 90 mm/sec, respectively, and the speed of the hammer bank is 380 mm/sec. The duration for the hammer bank 1 to perform one scan is in the range of 30 to 35 milliseconds.

As described, since the time when the ink ribbon moving speed returns to regular occurs earlier and the time when it shifts to low also occurs earlier, ruled-lines can be printed with a high quality which may otherwise printed blurred.

What is claimed is:

1. In a dot line printer including a hammer bank shuttling back and forth, from a first position to a second position, in a direction transverse to a sheet of print paper, the hammer bank accommodating a plurality of print hammers, an endless ink ribbon uni-directionally moving through a space defined between the hammer bank and the sheet of print paper, wherein the print hammers are selectively fired to make dot impressions on the sheet of print paper through the ink ribbon during said shuttling of said hammer bank, a method of controlling a moving speed of said ink ribbon comprising the steps of:

detecting a direction in which said hammer bank moves;

moving said ink ribbon at a first speed when the direction of movement of said hammer bank is opposite to that of said ink ribbon and for a predetermined period of time after said hammer bank reverses direction; and moving said ink ribbon at a second speed after said predetermined period of time has elapsed from a time when said hammer bank reverses direction and starts moving in the same direction as said ink ribbon; wherein said first speed is slower than said second speed, and said predetermined period of time is pre-selected so as to allow stretch in said ink ribbon, caused by said hammer bank moving in a direction to the direction of movement opposite thereof, to dissipate.

2. A method according to claim 1, wherein the first and second speeds of said ink ribbon are substantially equal to one-fifth and one-half of the speed of said hammer bank, respectively.

3. A method according to claim 1, wherein the predetermined period of time is equal to or less than a half of a period of time necessary for said hammer bank to move from said first position to said second position.

4. A method according to claim 1, wherein said ink ribbon is brought to said first speed at a time when said direction of movement of said hammer bank changes to a direction opposite to a direction of movement of said ink ribbon.

5. A method according to claim 1, wherein said ink ribbon is brought to the first speed before said hammer bank changes its moving direction to be opposite to the moving direction of said ink ribbon.

6. A dot line printer comprising:

a hammer bank accomodating a plurality of print hammers;

a hammer bank drive means for reciprocating said hammer bank at a given speed in first and second directions, which are opposite to each other, and for reversing direction at two opposite ends, said hammer bank accommodating a plurality of print hammers;

an endless ink ribbon ribbon drive means for uni-directionally moving said ribbon in said first direction through a space defined between said hammer bank and a sheet of print paper, wherein the print hammers are selectively fired to make dot impressions on the sheet of print paper;

direction detecting means for detecting a direction in which said hammer bank moves, said direction detecting means producing a first signal when said hammer bank reverses direction at one of said opposite ends and thereafter moves in said second direction, and a second signal when said hammer bank reverses direction at the other of said opposite ends and thereafter moves in said first direction;

said ink ribbon drive means being selectively responsive to said first and second signals and operatively engaged with said ink ribbon so as to selectively move said ink ribbon at first and second moving speeds, said first moving speed being slower than said second moving speed, said ink ribbon drive means moving said ink ribbon at said first moving speed in response to said first signal and at said second moving speed after a predetermined period of time has elapsed from the production of said second signal;

said predetermined period of time being pre-selected so as to allow stretch in said ink ribbon, caused by said hammer bank, moving in a direction opposite thereof, to dissipate.

7. An apparatus according to claim 6, wherein said first and second moving speeds of said ink ribbon are substantially equal to one-fifth and one-half of said given speed of said hammer bank, respectively.

8. An apparatus according to claim 6, wherein said predetermined period of time is equal to or less than a half of a period of time necessary for said hammer bank to move from said one of said opposite ends to said other of said opposite ends.

9. An apparatus according to claim 6, wherein said ink ribbon is brought to said first moving speed at a time when said hammer bank changes its moving direction to move in said second direction.

10. An apparatus according to claim 6, wherein said ink ribbon is brought to said first moving speed before said hammer bank changes its moving direction to move in said second direction.

* * * * *